US010755626B2

(12) United States Patent
Hwang

(10) Patent No.: US 10,755,626 B2
(45) Date of Patent: Aug. 25, 2020

(54) DISPLAY DEVICE AND DRIVING METHOD OF THE SAME

(71) Applicant: Samsung Display Co., Ltd., Yongin-si, Gyeonggi-do (KR)

(72) Inventor: Jong-kwang Hwang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/200,522

(22) Filed: Nov. 26, 2018

(65) Prior Publication Data

US 2019/0180677 A1 Jun. 13, 2019

(30) Foreign Application Priority Data

Dec. 11, 2017 (KR) ..... 10-2017-0169548

(51) Int. Cl.
*G09G 3/3208* (2016.01)
*G09G 3/3233* (2016.01)

(52) U.S. Cl.
CPC ..... *G09G 3/3208* (2013.01); *G09G 3/3233* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01); *G09G 2310/08* (2013.01); *G09G 2320/0257* (2013.01); *G09G 2320/064* (2013.01); *G09G 2320/0686* (2013.01)

(58) Field of Classification Search
CPC ... G09G 2300/0819; G09G 2300/0842; G09G 2300/0861; G09G 2310/0251; G09G 2310/0262; G09G 2310/08; G09G 2320/0257; G09G 2320/064; G09G 2320/0686; G09G 3/3208; G09G 3/3233
See application file for complete search history.

(56) References Cited

U.S. PATENT DOCUMENTS 7,202,842 B2 * 4/2007 Kasai ..... G09G 3/3225 345/693
8,982,164 B2 3/2015 Pyo
9,269,294 B2 2/2016 Eom et al.
9,324,270 B2 4/2016 Jeong
(Continued)

FOREIGN PATENT DOCUMENTS

KR 10-2013-0099588 A 9/2013
KR 10-2013-0136338 A 12/2013
(Continued)

*Primary Examiner* — Afroza Chowdhury
(74) *Attorney, Agent, or Firm* — Lewis Roca Rothgerber Christie LLP

(57) ABSTRACT

A display device includes a display panel having a pixel and a light emitting unit configured to output a light emission control signal controlling light emitting timing of the pixel. A luminance of the pixel has a first luminance section and a second luminance section different from the first luminance section. A first time interval between a rising edge of the light emission control signal and a rising edge of a vertical synchronization signal representing a start of the frame period is adjusted in the first luminance section and a second time interval between a falling edge of the light emission control signal and the rising edge of the vertical synchronization signal is adjusted in a second luminance section.

18 Claims, 10 Drawing Sheets

(56) References Cited

U.S. PATENT DOCUMENTS

| | | | | |
|---|---|---|---|---|
| 2005/0062710 | A1* | 3/2005 | Kasai | G09G 3/3225 345/99 |
| 2015/0109270 | A1* | 4/2015 | Ito | G09G 3/3677 345/207 |
| 2015/0287350 | A1* | 10/2015 | Jun | G09G 3/006 345/690 |
| 2017/0061878 | A1 | 3/2017 | Park et al. | |

FOREIGN PATENT DOCUMENTS

| | | | |
|---|---|---|---|
| KR | 10-2015-0010807 | A | 1/2015 |
| KR | 10-2015-0081803 | A | 7/2015 |
| KR | 10-2017-0026971 | A | 3/2017 |

* cited by examiner

DISPLAY DEVICE AND DRIVING METHOD OF THE SAME

CROSS-REFERENCE TO RELATED APPLICATION

This application claims priority to and the benefit of Korean Patent Application No. 10-2017-0169548, filed on Dec. 11, 2017, the entire contents of which are hereby incorporated by reference.

BACKGROUND

The present disclosure herein relates to a display device and a driving method to enhance display characteristics.

An organic light emitting display device includes a light emitting element that may generate light through recombination of electrons and holes. The organic light emitting display device has a rapid response speed and is driven with low power consumption. However, when a moving picture is displayed on the organic light emitting display device, an afterimage may remain and cause a contour of an object to become blurred and unclear.

SUMMARY

The present disclosure provides a display device and a driving method of the display device that control a driving scheme according to each luminance section to enhance display characteristics. An embodiment of the inventive concept includes an impulse driving scheme where an image is displayed for some time and a black color is displayed for the other time.

An embodiment of the inventive concept provides a display device having a display panel that includes a pixel and is configured to display an image and a light emitting unit configured to output a light emission control signal controlling light emitting timing of the pixel in a frame period. A pixel has a luminance with a first luminance section and a second luminance section different from the first luminance section. A first time interval between a rising edge of the light emission control signal and a rising edge of a vertical synchronization signal representing a start of the frame period is adjusted in the first luminance section. A second time interval between a falling edge of the light emission control signal and the rising edge of the vertical synchronization signal is adjusted in the second luminance section.

In an embodiment, a third time interval between the falling edge of the light emission control signal and the rising edge of the vertical synchronization signal may be fixed in the first luminance section, and a fourth time interval between the rising edge of the light emission control signal and the rising edge of the vertical synchronization signal may be fixed in the second luminance section.

In an embodiment, the first luminance section may have a lower luminance than the second luminance section.

In an embodiment, a third luminance section may have a higher luminance than the second luminance section. In the third luminance section, a time interval between the rising edge of the light emission control signal and the rising edge of the vertical synchronization signal and a time interval between the falling edge of the light emission control signal and the rising edge of the vertical synchronization signal may be fixed.

In an embodiment, in the third luminance section, an off duty ratio of the light emission control signal may be 10% or higher.

In an embodiment, in the first luminance section, an off duty ratio of the light emission control signal may increase as the luminance becomes lower.

In an embodiment, in the second luminance section, an off duty ratio of the light emission control signal may increase as the luminance becomes lower.

In an embodiment, in the second luminance section, an off duty ratio of the light emission control signal may increase as the luminance becomes higher.

In an embodiment, in the first luminance section, a third time interval between the falling edge of the light emission control signal and the rising edge of a vertical synchronization signal may be adjusted, and as the luminance in the first luminance section becomes lower, the third time interval may decrease.

In an embodiment, a third luminance section that is an intermediate luminance section between the first luminance section and the second luminance section may have a time interval between the rising edge of the light emission control signal and the rising edge of the vertical synchronization signal, and a time interval between the falling edge of the light emission control signal and the rising edge of the vertical synchronization signal may be all adjusted.

In an embodiments of the inventive concept, a display device includes a display panel comprising a pixel and configured to display an image and a light emission control unit configured to output a light emission control signal. The light emission control signal may include an on level for driving the pixel to emit light and an off level allowing the pixel not to emit light. A luminance of the pixel has a first luminance section and a second luminance section having a higher luminance than the first luminance section. A front point of the off level of the light emission control signal is adjusted in the first luminance section and a rear point of the off level of the light emission control signal is adjusted in the second luminance section.

In an embodiment, the rear point of the off level of the light emission control signal in the first luminance section and the front point of the off level of the light emission control signal in the second luminance section may be fixed.

In an embodiment, in the first luminance section, an off duty ratio of the light emission control signal may increase as the luminance becomes lower.

In an embodiment, in the second luminance section, an off duty ratio of the light emission control signal may increase as the luminance becomes lower.

In an embodiment, in the second luminance section, an off duty ratio of the light emission control signal may increase as the luminance becomes higher.

In an embodiment, in the first luminance section, the rear point of the off level of the light emission control signal may be adjusted.

In an embodiments of the inventive concept, a driving method of a display device includes: providing a scan signal to a scan line electrically connected to a pixel comprising a pixel circuit and a light emitting element; delivering, to the pixel circuit, a data signal received from a data line according to a level of the scan signal; adjusting a duty ratio of a light emission control signal according to a luminance; and applying, to the pixel circuit, the light emission control signal so as to control timing when a driving current flows to the light emitting element, wherein in the adjusting of the duty ratio, when the luminance is in a first luminance section, a front point of an off level of the light emission control signal is adjusted, and when the luminance is in a second luminance section having higher luminance than the first luminance section, a rear point of the off level of the light emission control signal is adjusted.

In an embodiment, in the adjusting of the duty ratio, in the first luminance section, a time interval between a rising edge of the light emission control signal and a rising edge of a vertical synchronization signal that represents a start of a frame period may be adjusted and a time interval between a falling edge of the light emission control signal and the rising edge of the vertical synchronization signal may be fixed. In the second luminance section, a time interval between the rising edge of the light emission control signal and the rising edge of the vertical synchronization signal may be fixed, and a time interval between the falling edge of the light emission control signal and the rising edge of the vertical synchronization signal may be adjusted.

In an embodiment, in the first luminance section and the second luminance section, an off duty ratio of the light emission control signal may increase as the luminance becomes lower.

In an embodiment, in the first luminance section, an off duty ratio of the light emission control signal may increase as the luminance becomes lower, and in the second luminance section, the off duty ratio of the light emission control signal may increase, as the luminance becomes higher.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
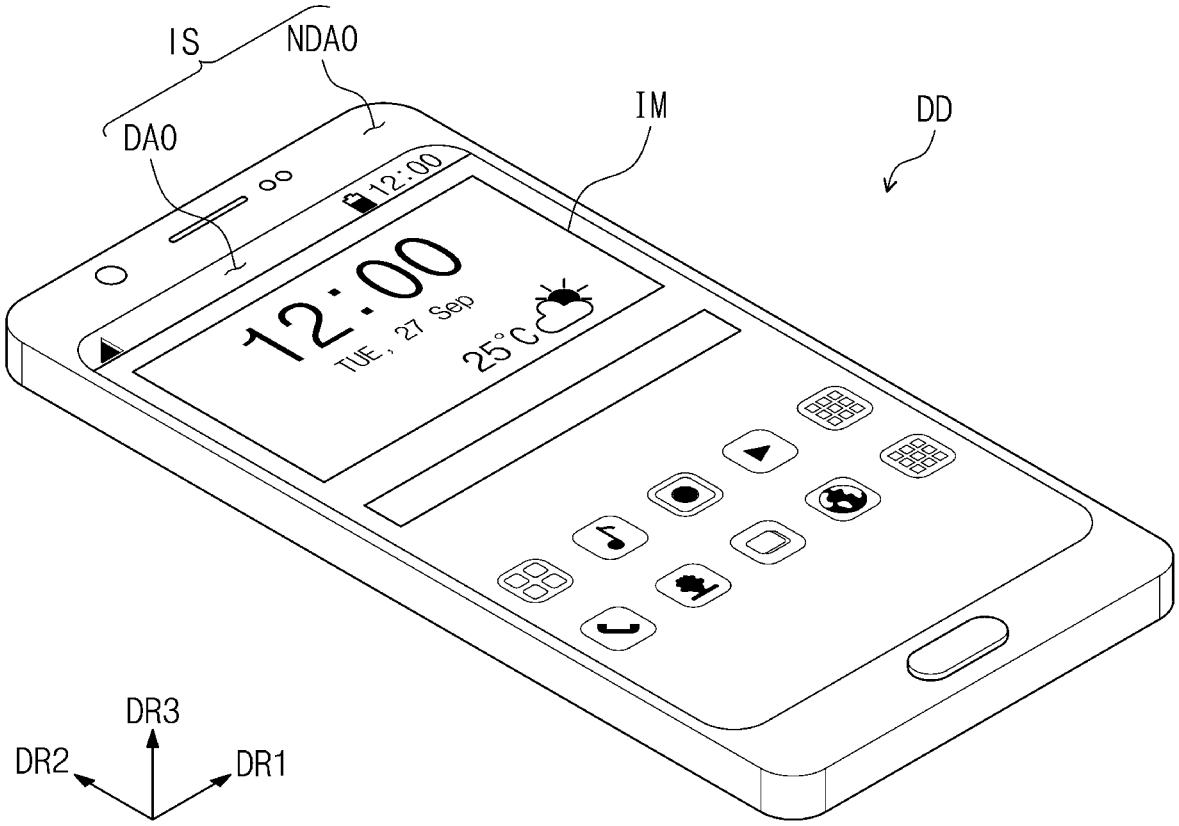
FIG. 1 is a perspective view of a display device according to an embodiment of the inventive concept.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

Terms such as first, second, and the like may be used to describe various components, but these components should not be limited by the terms. The terms are used only for the purpose of distinguishing one component from another component. For instance, a first component may be referred to as a second component, or similarly, a second component may be referred to as a first component, without departing from the scope of the present invention. The singular forms "a," "an" and "the" are intended to include the plural forms as well, unless the context clearly indicates otherwise.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a perspective view of a display device according to an embodiment of the inventive concept.

In relation to FIG. 1, the display device DD may display an image IM at a display surface IS. The display surface IS may be an outermost surface of the display device DD, which may be watched by a user.

In FIG. 1, as an example, the image IM may include a clock widget and application icons. FIG. 1 exemplarily illustrates that the display surface IS has a surface defined by a first direction DR1 and a second direction DR2 intersecting with the first direction DR1. However, in another embodiment, a display surface (not shown) of a display device (not shown) may be curved.

The normal direction of the display surface IS (e.g. the thickness direction of the display device DD) directs a third direction DR3. Directions indicated by the first to third directions DR1, DR2, and DR3 are a relative concept and may be changed to other directions. Hereinafter, the first to third directions are respectively indicated by the first to third directions DR1, DR2, and DR3 and are referred to with the same reference numerals.

In FIG. 1, the display device DD is exemplarily illustrated as a mobile electronic device. However, the display device DD may also be used in large electronic devices such as an external billboard and in small and medium-sized electronic devices such as a personal computer, notebook computer, personal digital terminal, car navigation unit, game console, smartphone, tablet, and a camera. In addition, these are presented only as example embodiments, and the display device DD may also be employed in other electronic devices without deviating from the inventive concept.

The display surface IS includes a display area DA0 on which the image IM is displayed and a non-display area NDA0 adjacent to the display area DA0. The non-display area NDA0 is an area on which the image is not displayed. The non-display area NDA0 may surround the display area DA0. However, the embodiment of the inventive concept is not limited thereto, and the display area shape and non-display area may have any suitable shapes. For example, in some embodiments, the display surface IS may not include the non-display area NDA0.

Figure 2:
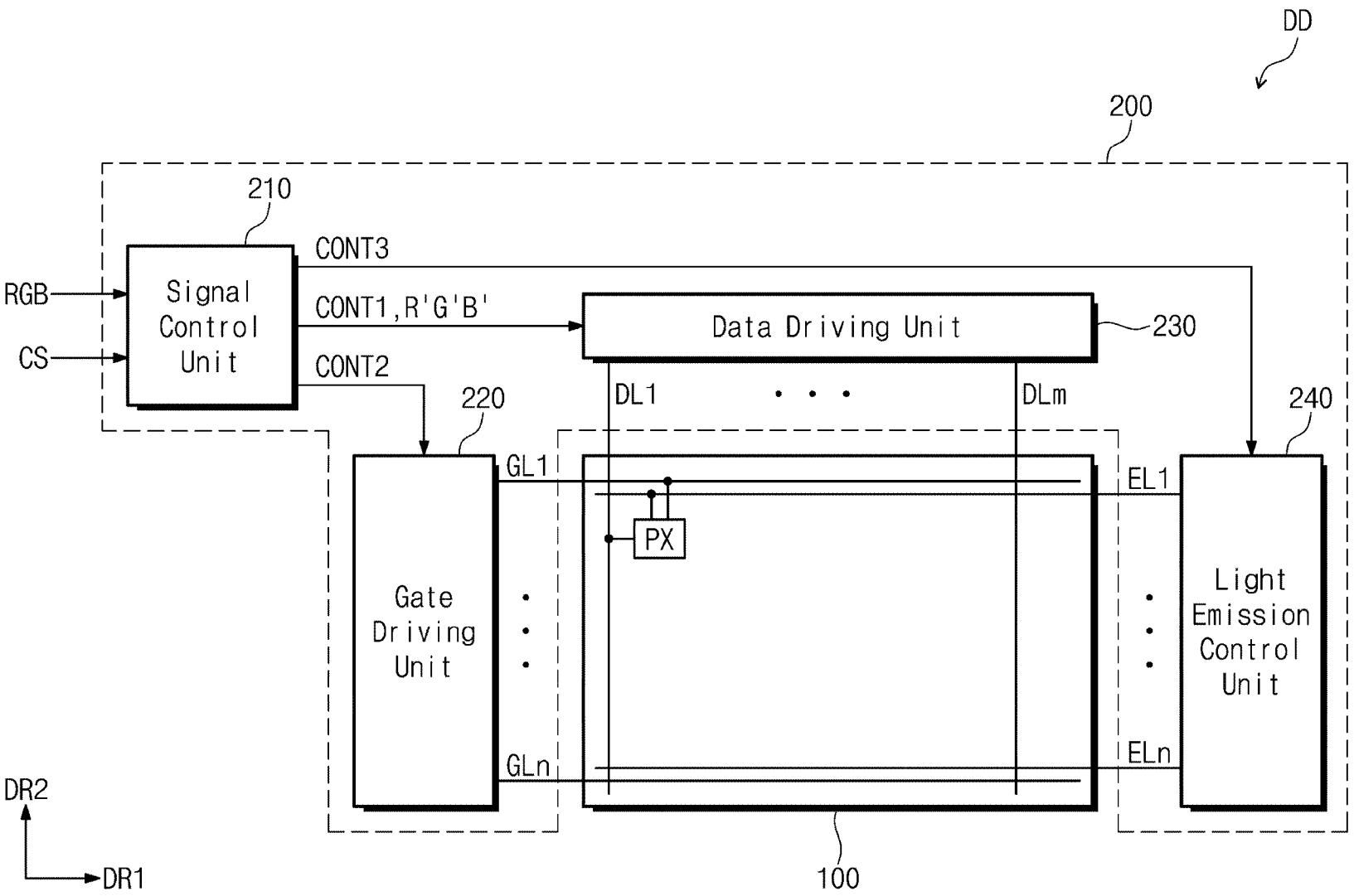
FIG. 2 is a block diagram of a display device according to an embodiment of the inventive concept.

FIG. 2 is a block diagram of a display device according to an embodiment of the inventive concept.

In relation to FIG. 2, the display device DD may include a display panel 100 and a driving circuit 200. The driving circuit 200 is a circuit for driving the display panel 100, and may include a signal control unit 210, a gate driving unit 220, a data driving unit 230, and a light emission control unit 240.

The display panel 100 may be an organic light emitting display panel. The display panel 100 may include a plurality of data lines DL1 to DLm, a plurality of scan lines GL1 to GLn, a plurality of light emission control lines EL1 to ELn, and a plurality of pixels PX.

The plurality of scan lines GL1 to GLn and the plurality of light emission control lines EL1 to ELn may be extended in the first direction DR1, and arrayed along the second direction DR2 intersecting with the first direction DR1. The plurality of data lines DL1 to DLm may be extended in the second direction DR2, and arrayed along the first direction DR1. The plurality of data lines DL1 to DLm, the plurality of light emission control lines EL1 to ELn, and the plurality of scan lines GL1 to GLn may define pixel areas, and the pixel areas may be provided with the pixels PX for displaying an image. In FIG. 2, a pixel PX connected to a first data line DL1, a first scan line GL1, and a first light emission control line EL1 is exemplarily illustrated.

The pixel PX may display a primary color or a mixed color. The primary color may include red, green, or blue, and the mixed color may include various colors such as white, yellow, cyan, or magenta. However, the color displayed by the pixel PX is not limited thereto.

The signal control unit 210 (or a timing controller) may receive a control signal CS and image data RGB provided from an outside source. The signal control unit 210 may provide a first control signal CONT1 and an image data signal R'G'B' to the data driving unit 230, a second control signal CONT2 to the gate driving unit 220, and a third control signal CONT3 to the light emission control unit 240.

The first control signal CONT1 may be a signal controlling the data driving unit 230, the second control signal CONT2 may be a signal controlling the gate driving unit 220, and the third control signal CONT3 may be a signal controlling the light emission control unit 240.

The data driving unit 230 may drive the plurality of data lines DL1 to DLm in response to the first control signal CONT1 received from the signal control unit 210. The data driving unit 230 may be independently implemented as an integrated circuit that is either electrically connected to one side of the display panel 100 or directly mounted on the display panel 100. In addition, the data driving unit 230 may be implemented as a signal chip or include a plurality of chips.

The gate driving unit 220 drives the scan lines GL1 to GLn in response to the second control signal CONT2 from the signal control unit 210. The gate driving unit 220 may be integrated on a prescribed area of the display panel 100. The gate driving unit 220 may be implemented to a circuit using such as an Amorphous Silicon Gate Driver (ASG) using amorphous Silicon Thin Film Transistor (a-Si TFT), and Oxide Silicon Gate Driver (OSG) using oxide silicon thin film transistor, semiconductor oxides, crystalline semiconductor, or polycrystalline semiconductor. Furthermore, the gate driving unit 220 may be implemented to an independent integrated circuit chip to be electrically connected to one side of the display panel 100. In another embodiment, the gate driving unit 220 may be implemented to a tape carrier package (TCP) or a chip on film (COF).

The light emission control unit 240 may drive the light emission control lines EL1 to ELn in response to the third control signal CONT3 from the signal control unit 210. The light emission control unit 240 may be integrated with the gate driving unit 220, or may be separate. The light emission control unit 240 may be integrated on a prescribed area of the display panel 100, or implemented to an independent integrated circuit chip that is electrically connected to one side of the display panel 100.

While a gate-on voltage is applied to at least one of the plurality of scan lines GL1 to GLn, the respective switching transistors of a row of pixels connected thereto are turned on. At this point, the data driving unit 230 provides data driving signals corresponding to the image data signal R'G'B' to the data lines DL1 to DLm. The data driving signals provided to the data lines DL1 to DLm are respectively applied to the corresponding pixels PX through the turned-on switching transistors. The light emission control unit 240 may apply a light emission control signal to at least one of the light emission control lines EL1 to ELn to determine timing when the driving current flows to the light emitting element OLED (see FIG. 3).

Figure 3:
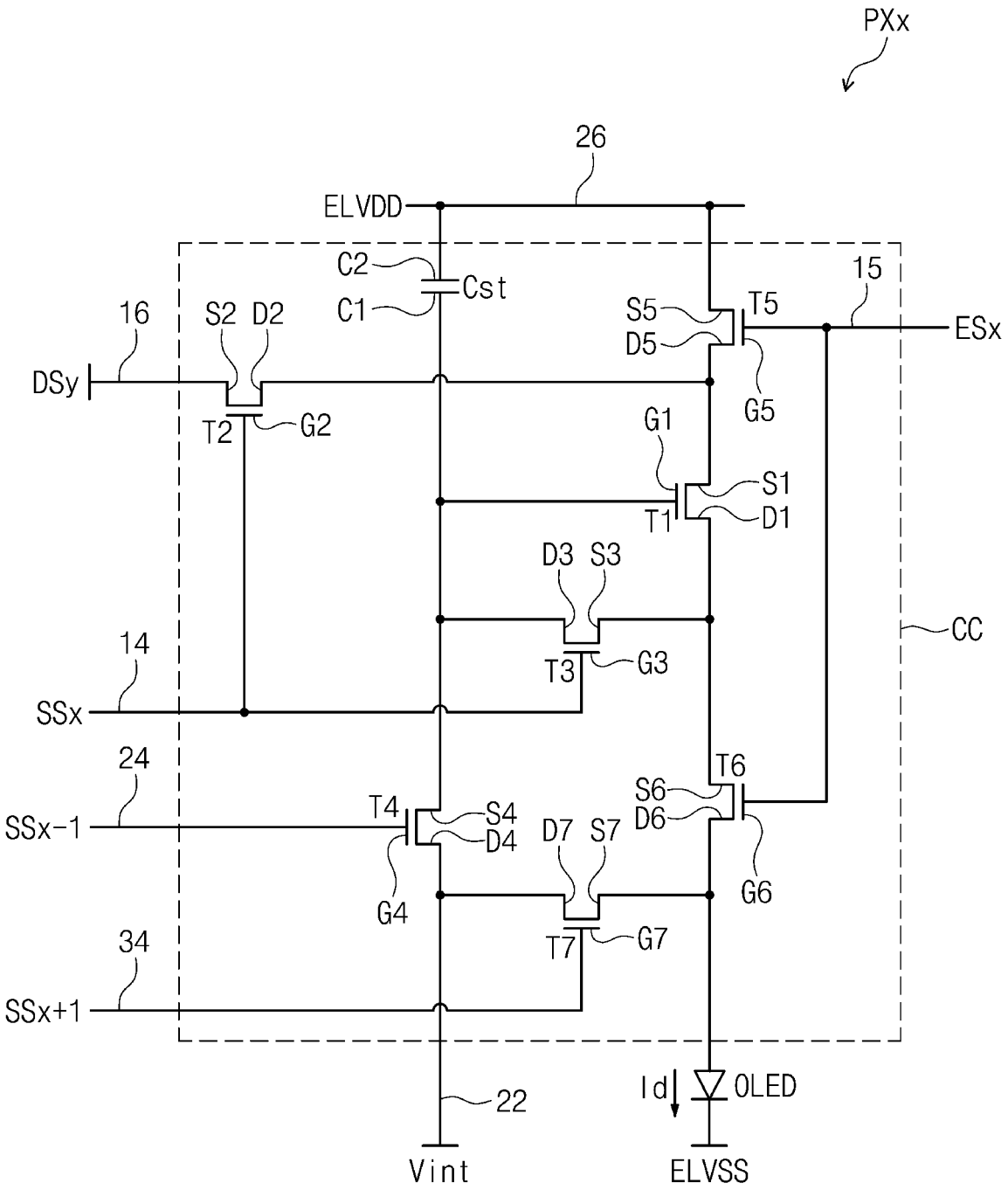
FIG. 3 is an equivalent circuit diagram of a pixel according to an embodiment of the inventive concept.
Figure 4:
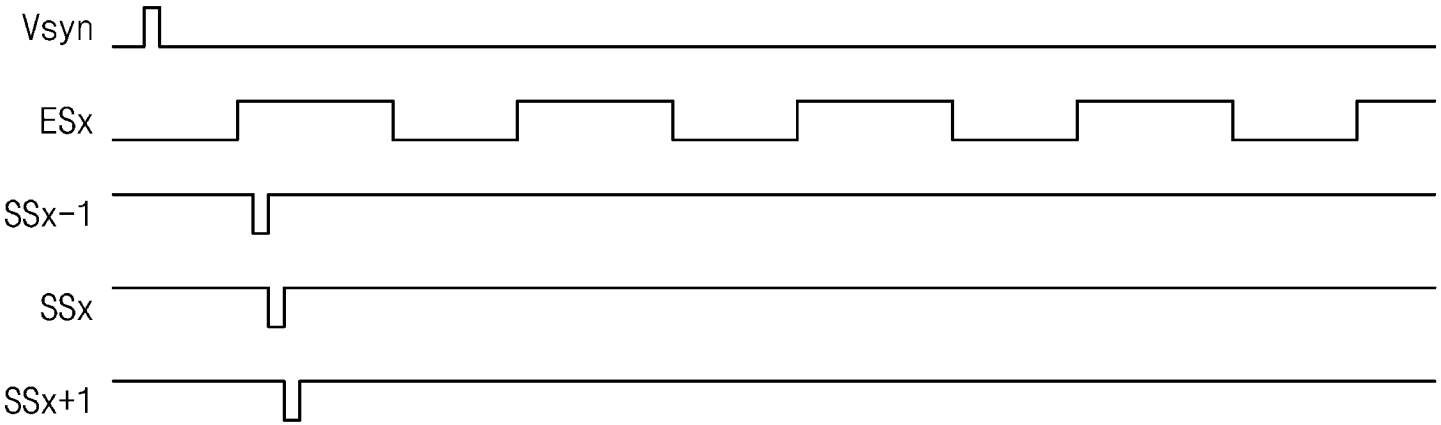
FIG. 4 exemplarily illustrates a vertical synchronization signal, a light emission control signal applied to the pixel of FIG. 3, and scan signals.

FIG. 3 is an equivalent circuit diagram of a pixel according to an embodiment of the inventive concept, and FIG. 4 exemplarily illustrates the vertical synchronization signal, the light emission control signal and the scan signals applied to the pixel of FIG. 3. In FIG. 3, one pixel PXx is exemplarily illustrated.

In relation to FIG. 3, the pixel PXx may include a pixel circuit CC and a light emitting element OLED.

The light emitting element OLED may include an organic light emitting diode. However, an embodiment of the inventive concept is not limited thereto, but may include an inorganic light emitting diode or an organic-inorganic hybrid light emitting diode (see FIG. 2).

The pixel circuit CC may include a plurality of transistors T1 to T7, and a storage capacitor Cst. The plurality of transistors T1 to T7 may include a driving transistor T1, a switching transistor T2, a compensation transistor T3, an initialization transistor T4, a first light emission control transistor T5, a second light emission control transistor T6, and a bypass transistor T7.

The pixel PXx is connected to a first scan line 14 delivering an x-th scan signal SSx to the switching transistor T2 and the compensation transistor T3, a second scan line 24 delivering an (x−1)-th scan signal SSx−1 to the initialization transistor T4, a third scan line 34 delivering an (x+1)-th scan signal SSx+1 to the bypass transistor T7, a light emission control line 15 delivering a light emission control signal ESx to the first light emission control transistor T5 and the second light emission control transistor T6, a data line 16 delivering a data signal DSy, a power line 26 delivering a power supply voltage ELVDD, and an initialization line 22 delivering an initialization voltage Vint initializing the driving transistor T1.

A gate electrode G1 of the driving transistor T1 is connected to a first electrode C1 of the storage capacitor Cst. A source electrode S1 of the driving transistor T1 is connected to the power line 26 via the first light emission control transistor T5. A drain electrode D1 of the driving transistor T1 is electrically connected to an anode of the light emitting element OLED via the second light emission control transistor T6. The driving transistor T1 receives the data signal DSy according to a switching operation of the switching transistor T2 and supplies a driving current Id to the light emitting element OLED.

The gate electrode G2 of the switching transistor T2 is connected to the first scan line 14. A source electrode S2 of the switching transistor T2 is connected to the data line 16. A drain electrode D2 of the switching transistor T2 is connected to a source electrode S1 of the driving transistor T1 and is connected to the power line 26 via the first light emission control transistor T5. The switching transistor T2 is turned on according to the x-th scan line SSx received through the first scan line 14 to perform a switching operation for delivering the data signal DSy received through the data line 16 to the source electrode S1 of the driving transistor T1. For example, the switching transistor T2 may be turned on, when the x-th scan signal SSx has a low level. When the switching transistor T2 is turned on, the storage capacitor Cst stores a voltage corresponding to the data signal DSy.

A gate electrode G3 of the compensation transistor T3 is connected to the first scan line 14. A source electrode S3 of the compensation transistor T3 is connected to the drain electrode D1 of the driving transistor T1, and is connected to the anode of the light emitting element OLED via the second light emission control transistor T6. A drain electrode D3 of the compensation transistor T3 is connected to a first electrode C1 of the storage capacitor Cst, a source electrode S4 of the initialization transistor T4, and the gate electrode G1 of the driving transistor T1. The compensation transistor T3 is turned on in response to the x-th scan signal SSx received through the first scan line 14, and connects the gate electrode G1 and the drain electrode D1 of the driving transistor T1 to each other to diode-connect the driving transistor T1.

A gate electrode G4 of the initialization transistor T4 is connected to the second scan line 24. A drain electrode D4 of the initialization transistor T4 is connected to the initialization line 22. The source electrode S4 of the initialization transistor T4 is connected to a first electrode C1 of the storage capacitor Cst, the drain electrode D3 of the compensation transistor T3, and the gate electrode G1 of the driving transistor T1. The initialization transistor T4 is turned on in response to the (x−1)-th scan signal SSx−1 received through the second scan line 24 to deliver the initialization voltage Vint to the gate electrode G1 of the driving transistor T1 and initialize a voltage of the gate electrode G1 of the driving transistor T1. For example, the initialization transistor T4 may be turned on when the (x−1)-th scan line SSx−1 has a low level.

The first light emission control transistor T5 may be connected between the power line 26 and the driving transistor T1. A gate electrode G5 of the first light emission control transistor T5 is connected to the light emission control line 15. A source electrode S5 of the first light emission control transistor T5 is connected to the power line 26. A drain electrode D5 of the first light emission control transistor T5 is connected to the source electrode S1 of the driving transistor T1 and the drain electrode D2 of the switching transistor T2.

The second light emission control transistor T6 may be connected between the driving transistor T1 and the light emitting element OLED. A gate electrode G6 of the second light emission control transistor T6 is connected to the light emission control line 15. A source electrode S6 of the second light emission control transistor T6 is connected to the drain electrode D1 of the driving transistor T1 and the source electrode S3 of the compensation transistor T3. A drain electrode D6 of the second light emission control transistor T6 is electrically connected to the anode of the light emitting element OLED. The first light emission control transistor T5 and the second light emission control transistor T6 are turned on in response to the light emission control signal ESx received through the light emission control line 15. As the light emission control signal ESx is applied to the gate electrode G5 of the first light emission control transistor T5 and the gate electrode G6 of the second light emission control transistor T6, the first and second light emission control transistors T5 and T6 are turned on and the driving current Id flows to the light emitting element OLED. The first and second light emission control transistors T5 and T6 may determine timing when the driving current Id flows to the light emitting element OLED.

The light emission control signal ESx may include an on level and an off level. The on level of an embodiment of the inventive concept may correspond to a low level of the light emission control signal ESx, and the off level may correspond to a high level of the light emission control signal ESx. When the light emission control signal ESx has the high level, the first light emission control transistor T5 and the second light emission control transistor T6 are turned off. When the first light emission control transistor T5 is turned off, the power line 26 and the source electrode S1 of the driving transistor T1 are electrically cutoff. Accordingly, while a high level light emission control signal ESx is provided, the light emitting element OLED may not emit light.

A gate electrode G7 of the bypass transistor T7 is connected to the third scan line 34. A source electrode S7 of the bypass transistor T7 is connected to the anode of the light emitting element OLED. A drain electrode D7 of the bypass transistor T7 is connected to the initialization line 22. The bypass transistor T7 is turned on in response to the (x+1)-th scan signal SSx+1 received through the third scan line 34 to initialize the anode of the light emitting element OLED.

In addition, although the gate electrode G7 of the bypass transistor T7 is illustrated as being connected to the third scan line 34 in FIG. 3, the present invention is not limited thereto. In another embodiment of the present invention, the gate electrode G7 of the bypass transistor T7 may be connected to the first scan line 14 or second scan line 24.

The second electrode C2 of the storage capacitor Cst is connected to the power line 26. The first electrode C1 of the storage capacitor Cst is connected to the gate electrode G1 of the driving transistor T1, the drain electrode D3 of the compensation transistor T3, and the source electrode S4 of the initialization transistor T4.

The cathode of the light emitting element OLED receives a reference voltage ELVSS. The light emitting element OLED receives the driving current Id from the driving transistor T1 and emits light.

When the light emission control signal ESx has an on level, namely, a low level, the first light emission control transistor T5 and the second light emission control transistor T6 are turned on. When the first light emission control transistor T5 is turned on, the power supply voltage ELVDD is provided to the source electrode S1 of the driving transistor T1. When the second light emission control transistor T6 is turned on, the drain electrode D1 of the driving transistor T1 is electrically connected to the anode of the light emitting element OLED. Then, the light emitting element OLED generates light at a corresponding luminance in response to a current amount of the received driving current Id.

In another embodiment of the inventive concept, the number and connection relationship of the storage capacitors Cst and the plurality of transistors T1 to T7 forming the pixel PXx may be variously changed.

Figure 5:
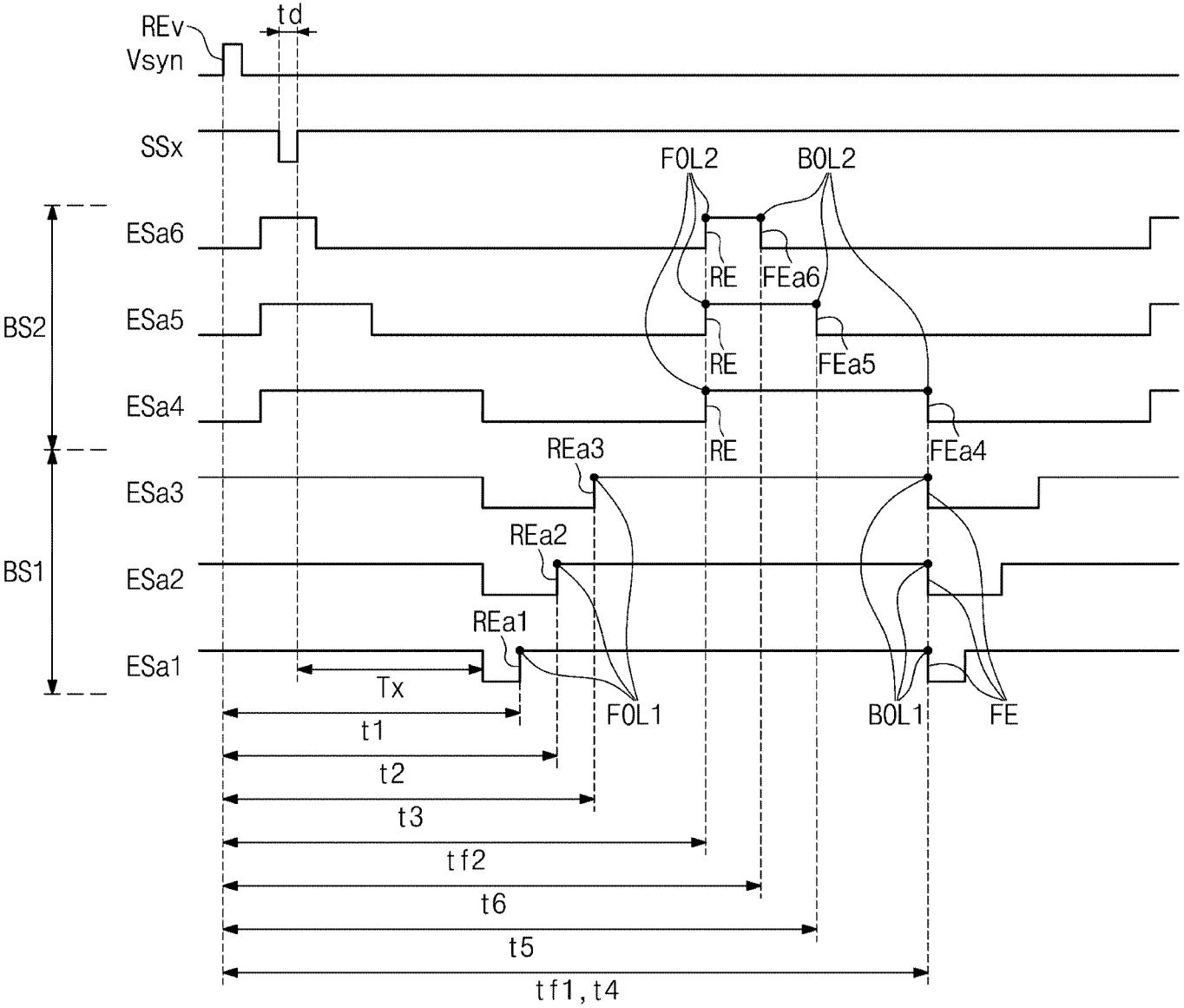
FIG. 5 illustrates a vertical synchronization signal, an x-th scan signal, and light emission control signals according to a luminance according to an embodiment of the inventive concept.

FIG. 5 illustrates a vertical synchronization signal, an x-th scan signal, and a light emission control signal according to luminance according to an embodiment of the inventive concept.

In relation to FIG. 5, the vertical synchronization signal Vsyn may be a signal representing a start of one frame. The first to sixth light emission control signals ESa1 to ESa6 may be light emission control signals provided to the pixels PXx, when the pixels PXx have different luminances (see FIG. 3).

The first to third light emission control signals ESa1 to ESa3 may be a portion of the light emission control signals when the pixels PXx have a luminance within a first luminance section BS1 and the fourth to sixth light emission control signals ESa4 to ESa6 are the other portion of the light emission control signals when the pixel PXx have a luminance within a second luminance section BS2.

The first luminance section BS1 may have a lower luminance than the second luminance section BS2. For example, the first luminance section BS1 may be a section in which the luminance is from 2 cd/m$^2$ to less than 100 cd/m$^2$, and the second luminance section BS2 may be a section in which the luminance is from 100 cd/m$^2$ to 750 cd/m$^2$. However, the numerical values are exemplary and a luminance boundary between the first luminance section BS1 and the second luminance section BS2 may be variously changed.

In the first luminance section BS1, off duty ratios of the first to third light emission control signals ESa1 to ESa3 may be adjusted to control the luminance of the pixel PXx. The off duty ratio may be a ratio occupied by a high level in one period of the light emission control signal. In this embodiment, the high level corresponds to an off period in which a pixel is not turned on, and thus is referred to as an off duty ratio.

In the second luminance section BS2, the off duty ratios of the fourth to sixth light emission control signals ESa4 to ESa6 and the data signal DSy (see FIG. 3) may also be controlled to control the luminance of the pixel PXx.

In FIG. 5, when the first light emission control signal ESa1 is provided, a first luminance of the pixel PXx may be the lowest, and when the sixth light emission control signal ESa6 is provided, the second luminance of the pixel PXx may be the highest. In other words, when the second to fifth light emission control signals ESa2 to ESa5 are provided to the pixel PXx, the pixel PXx may sequentially display luminances between the first luminance and the second luminance.

The off duty ratio of the first light emission control signal ESa1 may be the largest, and the off duty ratio of the sixth light emission control signal ESa6 may be the smallest. For example, when the luminance of 2 cd/m$^2$ is displayed with the first light emission control signal ESa1, the off duty ratio of the first light emission control signal ESa1 may be 98%. In each of the first luminance section BS1 and the second luminance section BS2, the off duty ratio may be controlled according to the luminance.

Each of the first to sixth light emission control signals ESa1 to ESa6 may include a rising edge and a falling edge. The rising edge may include when any of the first to sixth light emission control signals ESa1 to ESa6 is transitioned from a low level to a high level, and the falling edge may include when any of the first to sixth light emission control signals ESa1 to ESa6 is transitioned from the high level to the low level.

In the first luminance section BS1, front points FOL1 of the off levels of the first to third light emission control signals ESa1 to ESa3 may be adjusted. In this embodiment, since the off level is the high level, the front point FOL1 of the high level may be adjusted to adjust the off duty. In addition, in this embodiment, rear points BOL1 of the off levels of the first to third light emission control signals ESa1 to ESa3 may be fixed. The front point may be a time point at which the level of the signal changes from the on level to the off level, and the rear point may be the time point at which the level of the signal changes from the off level to the on level. For example, the front point may be the rising edge of the signal, and the rear point may be the falling edge of the signal.

Time intervals between a rising edge REv of the vertical synchronization signal Vsyn and the front points FOL1 of the off levels of the first to third light emission control signals ESa1 to ESa3 may be adjusted.

The rising edge REv of the vertical synchronization signal Vsyn and the rising edge REa1 of the first light emission control signal ESa1 may have a first time interval t1, the rising edge REv of the vertical synchronization signal Vsyn and the rising edge REa2 of the second light emission control signal ESa2 may have a second time interval t2, and the rising edge REv of the vertical synchronization signal Vsyn and the rising edge REa3 of the third light emission control signal ESa3 may have a third time interval t3. The first time interval t1, the second time interval t2, and the third time interval t3 may be different from each other. However, the falling edges FE of the first to third light emission control signals ESa1 to ESa3 may be fixed. Accordingly, the rising edge REv of the vertical synchronization signal Vsyn and the falling edges FE of the first to third light emission control signals ESa1 to ESa3 may have a fixed time interval tf1.

In the second luminance section BS2, the rear points BOL2 of the off levels of the fourth to sixth light emission control signals ESa4 to ESa6 may be adjusted. In this embodiment, since the off level is the high level, the rear point BOL2 of the high level may be adjusted to adjust the off duty. In addition, in this embodiment, the front points FOL2 of the off levels of the fourth to sixth light emission control signals ESa4 to ESa6 may be fixed.

Time intervals between the rising edge REv of the vertical synchronization signal Vsyn and the rear points BOL2 of the off levels of the fourth to sixth light emission control signals ESa4 to ESa6 may be adjusted.

The rising edge REv of the vertical synchronization signal Vsyn and the falling edge FEa4 of the fourth light emission control signal ESa4 has a fourth time interval t4, the rising edge REv of the vertical synchronization signal Vsyn and the falling edge FEa5 of the fifth light emission control signal ESa5 has a fifth time interval t5, and the rising edge REv of the vertical synchronization signal Vsyn and the falling edge FEa6 of the sixth light emission control signal ESa6 has a sixth time interval t6. The fourth time interval t4, the fifth time interval t5, and the sixth time interval t6 may be different from each other. However, the rising edges RE of the fourth to sixth light emission control signals ESa4 to ESa6 may be fixed. Accordingly, the rising edge REv of the vertical synchronization signal Vsyn and the rising edges RE of the fourth to sixth light emission control signals ESa4 to ESa6 may have a fixed time interval tf2.

According to an embodiment of the inventive concept, when controlling the off duty of the light emission control signal, the front point or the rear point of an off level is selectively adjusted according to a luminance section. Accordingly, since the rear point of the off level of the light emission control signal is controlled in the second luminance section BS2 that is a high luminance section, an afterimage phenomenon, in which a vestige of a previous image remains even when the image is changed another image, may be improved. In addition, since the front point of the off level of the light emission control signal is controlled in a first luminance section BS 1 that is a low luminance section, a response level of a first frame may be improved. For example, unlike the embodiment of the inventive concept, when the rear point of the off level is controlled in the first luminance section BS1, an interval Tx between a data input period td and a first on-period after a start of the frame may gradually increases, as the luminance becomes lower. As the interval Tx increases, a sufficient amount of current may not be delivered to the light emitting element OLED (see FIG. 3), in particular, in a low luminance. As a result, an image degradation phenomenon such as a color change may occur. However, according to an embodiment of the inventive concept, a front point of an off level is controlled in a section having a prescribed luminance or lower. Accordingly, the interval Tx between the data input period td and the first on-period of a light emission control signal after the frame start is fixed to prevent the image degradation phenomenon.

Figure 6:
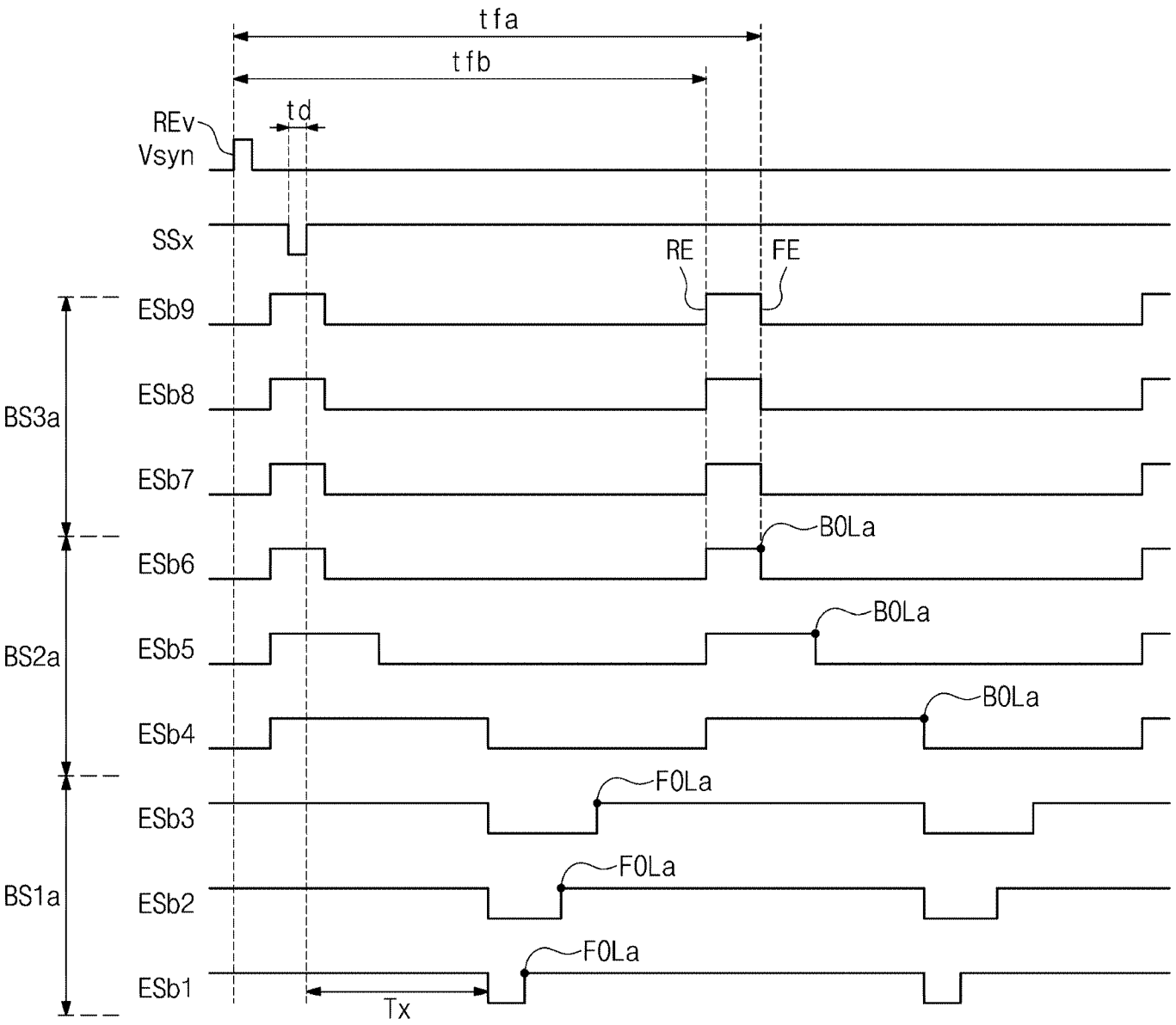
FIG. 6 illustrates a vertical synchronization signal, an x-th scan signal, and light emission control signals according to a luminance according to an embodiment of the inventive concept.

FIG. 6 illustrates a vertical synchronization signal, an x-th scan signal, and a light emission control signal according to luminance according to an embodiment of the inventive concept. In the description of FIG. 6, similar elements to the configuration described in relation to FIG. 5 will be briefly mentioned and a detailed description thereabout will be omitted.

In relation to FIG. 6, first to ninth light emission control signals ESb1 to ESb9 are illustrated. The first to ninth light emission control signals ESb1 to ESb9 may be light emission control signals provided to the pixel PXx, when the pixel PXx has different luminances (see FIG. 3).

The first to third light emission control signals ESb1 to ESb3 are a portion of the light emission control signals when the pixel PXx has a luminance within a first luminance section BS1*a*, and the fourth to sixth light emission control signals ESb4 to ESb6 are another portion of the light emission control signals when the pixel PXx has a luminance within a second luminance section BS2*a*. The seventh to ninth light emission control signals ESb7 to ESb9 are another portion of the light emission control signals when the pixel PXx has a luminance within a third luminance section BS3*a*.

The first luminance section BS1*a* may be a section in which the luminance is lower than that of the second luminance section BS2*a* and the third luminance section BS3*a* may be a section in which the luminance is higher than that of the second luminance section BS2*a*. For example, the third luminance section BS3*a* may be a luminance section having 100 cd/m$^2$ or higher.

In the first luminance section BS1*a*, front points FOLa of off levels of the first to third light emission control signals ESb1 to ESb3 may be adjusted similarly (e.g. substantially identically) to those of the first to third light emission control signals ESa1 to ESa3 (see FIG. 5) as described in relation to FIG. 5. Accordingly, the interval Tx between the data input period td and the first on-period of the light emission control signal after the frame start is fixed to prevent the image degradation phenomenon.

In the second luminance section BS2*a*, rear points BOLa of off levels of the fourth to sixth light emission control signals ESb4 to ESb6 may be adjusted similarly (e.g. substantially identically) to those of the fourth to sixth light emission control signals ESa4 to ESa6 (see FIG. 5) as described in relation to FIG. 5. Accordingly, an afterimage phenomenon that a vestige of a previous image remains may be improved.

In the third luminance section BS3*a*, duty ratios of the seventh to ninth light emission control signals ESb7 to ESb9 may be fixed. Accordingly, the time intervals tfa between the falling edges FE of the seventh to ninth light emission control signals ESb7 to ESb9 and the rising edge REv of the vertical synchronization signal Vsyn, and the time intervals tfb between the rising edges RE of the seventh to ninth light emission control signals ESb7 to ESb9 and the rising edge REv of the vertical synchronization signal Vsyn may be fixed.

In the third luminance section, the data signal Dsy (see FIG. 3) may be adjusted to control the luminance of the pixel PXx. Off duties of the seventh to ninth light emission control signals ESb7 to ESb9 in the third luminance section may be 10% or higher. This may be an example of a numerical value at which an afterimage phenomenon that a vestige of a previous image remains is not found. Accordingly, the off duties of the seventh to ninth light emission control signals ESb7 to ESb9 may be changed according to a magnitude, a type, or a driving voltage condition of the display panel 100 (see FIG. 2).

Figure 7:
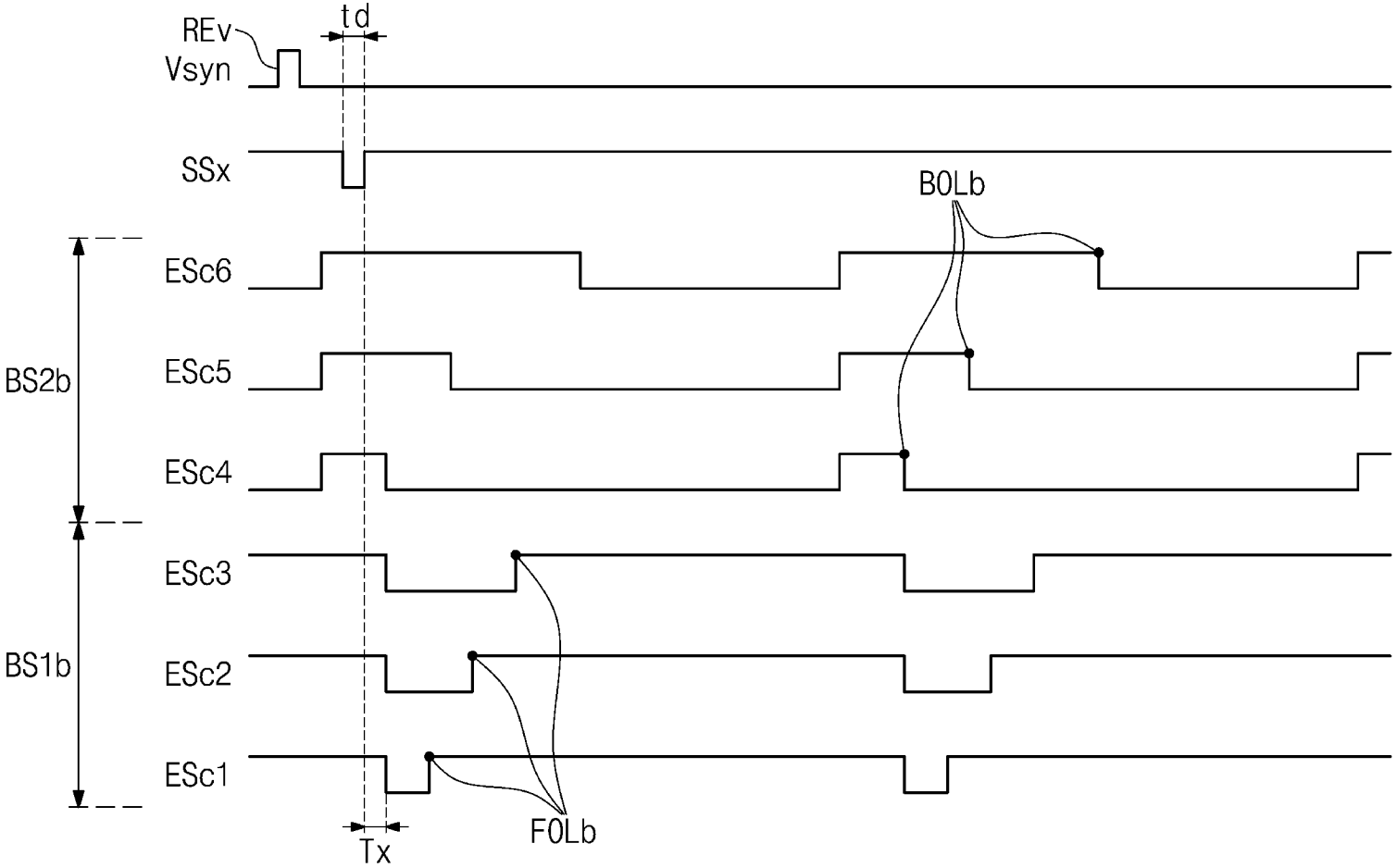
FIG. 7 illustrates a vertical synchronization signal, an x-th scan signal, and light emission control signals according to a luminance according to an embodiment of the inventive concept.

FIG. 7 illustrates a vertical synchronization signal, an x-th scan signal, and a light emission control signal according to luminance according to an embodiment of the inventive concept. In a description about FIG. 7, similar elements to the configuration described in relation to FIG. 5 will be briefly mentioned and a detailed description thereabout will be omitted.

In relation to FIG. 7, first to sixth light emission control signals ESc1 to ESc6 are illustrated. The first to sixth light emission control signals ESc1 to ESc6 may be light emission control signals provided to the pixel PXx, when the pixel PXx has different luminances (see FIG. 3).

The first to third light emission control signals ESc1 to ESc3 may be a portion of the light emission control signals when the pixel PXx has a luminance displayed within a first luminance section BS1*b*, and the fourth to sixth light emission control signals ESc4 to ESc6 are another portion of the light emission control signals when the pixel PXx has a luminance within a second luminance section BS2*b*.

In the first luminance section BS1*b*, front points FOLb of off levels of the first to third light emission control signals ESc1 to ESc3 may be adjusted similarly (e.g. substantially identically) to those of the first to third light emission control signals ESa1 to ESa3 (see FIG. 5) as described in relation to FIG. 5. Accordingly, the interval Tx between the data input period td and the first on-period of the light emission control signal after the frame start is fixed to prevent the image degradation phenomenon.

In the first luminance section BS1*b*, off duty ratios of the first to third light emission control signals ESc1 to ESc3 may be adjusted to control the luminance. In other words, as the luminance becomes lower in the first luminance section BS1*b*, the off duty ratio of the light emission control signal may increase. Accordingly, the off duty ratio of the first light emission control signal ESc1 that has the lowest luminance may be the largest among the first to third light emission control signals ESc1 to ESc3.

In the second luminance section BS2*b*, rear points BOLb of off levels of the fourth to sixth light emission control signals ESc4 to ESc6 may be adjusted to adjust the off duty ratio. As the luminance becomes higher in the second luminance section BS2*b*, the off duty ratio of the light emission control signal may increase. In other words, in an embodiment of the inventive concept, the off duty ratios of the fourth to sixth light emission control signals ESc4 to ESc6 may be adjusted in the second luminance section BS2*b* so as to adjust the afterimage phenomenon, and the luminance of the pixel PXx (see FIG. 3) may be controlled by adjusting the data signal DSy (see FIG. 3). Accordingly, the afterimage phenomenon in the high luminance section may be improved.

Figure 8:
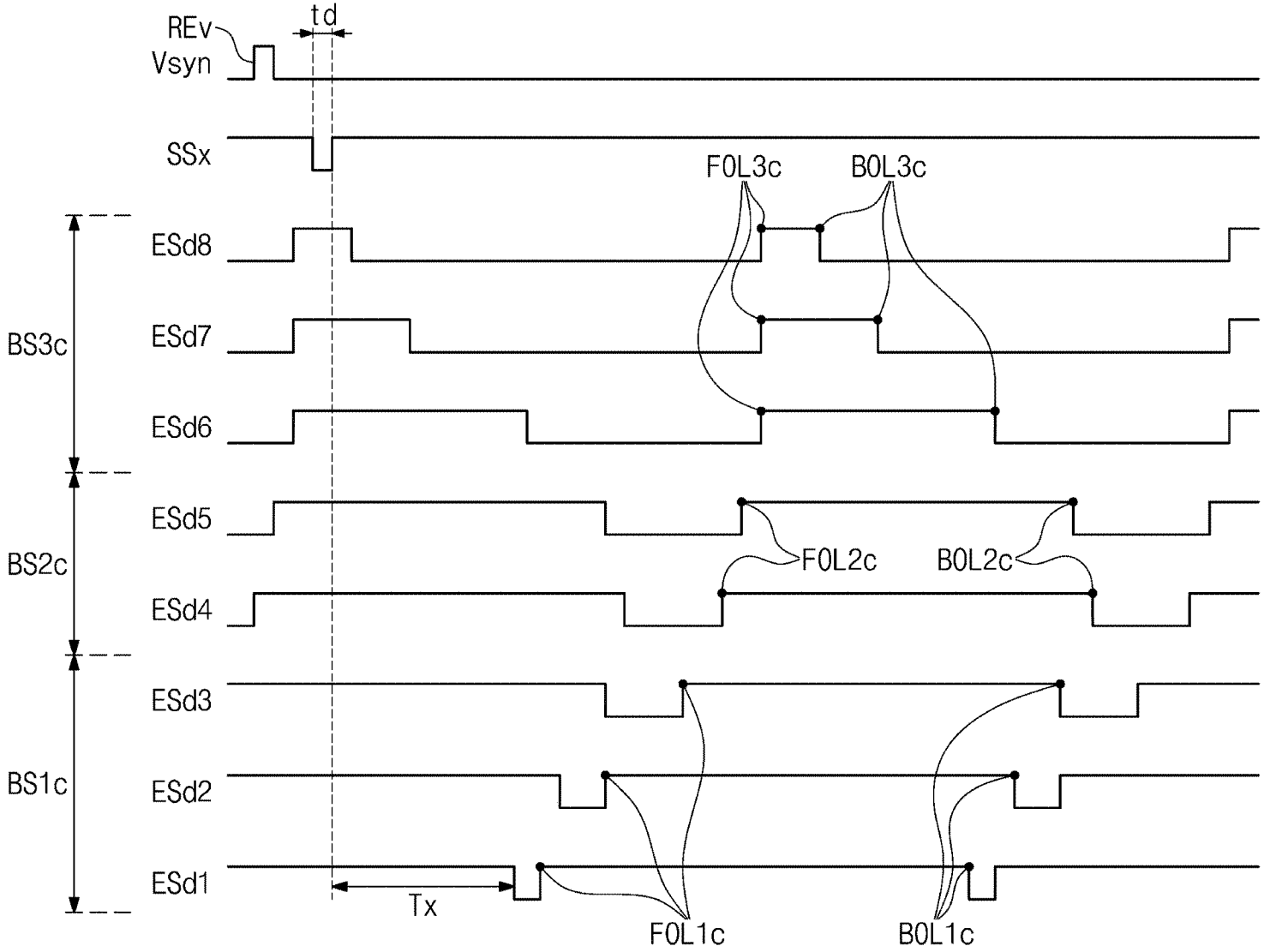
FIG. 8 illustrates a vertical synchronization signal, an x-th scan signal, and light emission control signals according to a luminance according to an embodiment of the inventive concept.

FIG. 8 illustrates a vertical synchronization signal, an x-th scan signal, and a light emission control signal according to luminance according to an embodiment of the inventive concept. In a description about FIG. 8, similar elements to the configuration described in relation to FIG. 5 will be briefly mentioned and a detailed description thereabout will be omitted.

In relation to FIG. 8, first to eighth light emission control signals ESd1 to ESc8 are illustrated. The first to eighth light emission control signals ESd1 to ESd8 may be light emission control signals provided to the pixel PXx, when the pixel PXx has different luminances (see FIG. 3).

The first to third light emission control signals ESd1 to ESd3 may be a portion of the light emission control signals when the pixel PXx has a luminance within a first luminance section BS1*c* and the fourth and fifth light emission control signals ESd4 and ESd5 are another portion of the light emission control signals when the pixel PXx has a luminance within a second luminance section BS2*c*. The sixth to eighth light emission control signals ESd6 to ESd8 may be another portion of the light emission control signals when the pixel PXx has a luminance within a third luminance section BS3*c*.

In the first luminance section BS1*c*, front points FOL1*c* of off levels and rear points BOL1*c* of the off levels of the first to third light emission control signals ESd1 to ESd3 may be all adjusted. For example, as the luminance becomes lower, the front point FOL1*c* of the off level may become closer to the data input period td and the rear point BOL1*c* of the off level may become closer to the data input period td. However, as the luminance becomes lower, the duty ratio may become gradually larger and thus the length of the off level may become gradually longer. For example, as the luminance becomes lower, a ratio that the front point FOL1*c* becomes closer to the data input period td may be larger than a ratio that the rear point BOL1*c* becomes closer to the data input period td. In this case, the interval Tx between the data input period td and the first on-period of the light emission control signal after the frame start may become shorter to prevent the image degradation phenomenon.

In the second luminance section BS2*c*, front points FOL2*c* and rear points BOL2*c* of off levels of the fourth and fifth light emission control signals ESd4 and Esd5 may be all adjusted. For example, as the luminance becomes lower, the front point FOL2*c* becomes closer to the data input period td and the rear point BOL2*c* becomes longer to the data input period td.

In the third luminance section BS3*c*, rear points BOL3*c* of off levels of the sixth to eighth light emission control signals ESd6 to ESd8 may be adjusted similarly (e.g. substantially identically) to those of the fourth to sixth light emission control signals ESa4 to ESa6 (see FIG. 5) as described in relation to FIG. 5, and the afterimage phenomenon that a vestige of a previous image remains may be improved. In addition, the front point FOL3*c* of the off level may be fixed.

Figure 9:
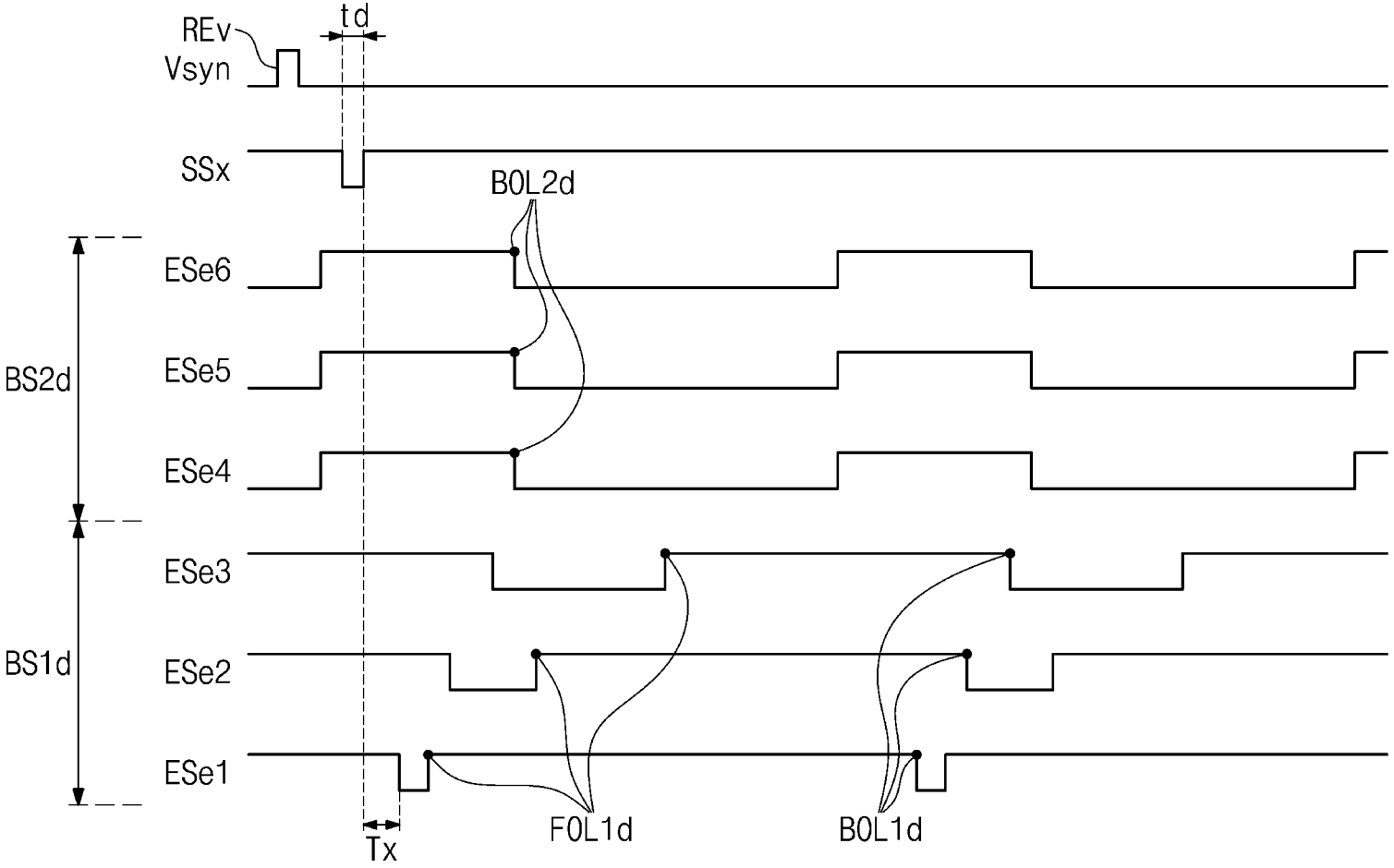
FIG. 9 illustrates a vertical synchronization signal, an x-th scan signal, and light emission control signals according to a luminance according to an embodiment of the inventive concept.

FIG. 9 illustrates a vertical synchronization signal, an x-th scan signal, and a light emission control signal according to luminance according to an embodiment of the inventive concept. In a description about FIG. 9, similar elements to the configuration described in relation to FIG. 8 will be briefly mentioned and a detailed description thereabout will be omitted.

In relation to FIG. 9, first to sixth light emission control signals ESe1 to ESe6 are illustrated. The first to sixth light emission control signals ESe1 to ESe6 may be light emission control signals provided to the pixel PXx, when the pixel PXx has different luminances (see FIG. 3).

The first to third light emission control signals ESe1 to ESe3 are a portion of the light emission control signals when the pixel PXx has a luminance within a first luminance section BS1*d*, and the fourth to sixth light emission control signals ESe4 to ESe6 illustrate the other portion of the light emission control signals, when the pixel PXx has a luminance within a second luminance section BS2*d*. The second luminance section BS2*d* may have a higher luminance than the first luminance section BS1*d*.

In the first luminance section BS1*d*, front points FOL1*d* and rear points BOL1*d* of the off levels of the first to third light emission control signals ESe1 to ESe3 may all be adjusted similarly (e.g. substantially identically) to those of the first to third light emission control signals ESd1 to ESd3 (see FIG. 8) as described in relation to FIG. 8.

In the second luminance section BS2*d*, rear points BOL2*d* of off levels of the fourth to sixth light emission control signals ESe4 to ESe6 may be adjusted to have a prescribed off duty ratio so as to be able to improve the afterimage phenomenon in which a vestige of a previous image remains. For example, the off duty ratio may be 10% or higher. In the second luminance section BS2*d*, the rear point BOL2*d* of the off level may be fixed and the data signal DSy (see FIG. 3) is adjusted to control the luminance of the pixel PXx.

Figure 10:
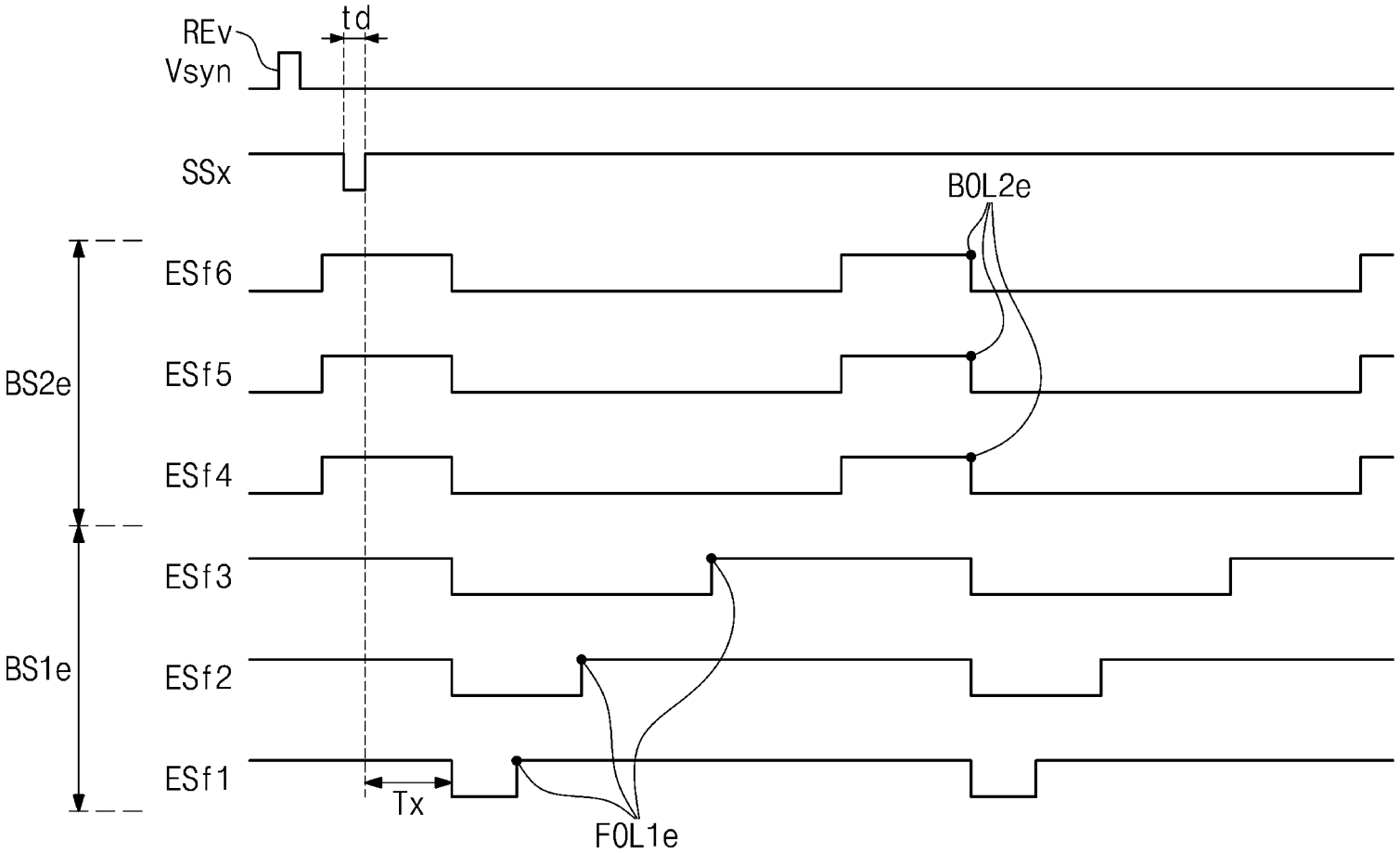
FIG. 10 illustrates a vertical synchronization signal, an x-th scan signal, and light emission control signals according to a luminance according to an embodiment of the inventive concept.

FIG. 10 illustrates a vertical synchronization signal, an x-th scan signal, and a light emission control signal according to luminance according to an embodiment of the inventive concept. In a description about FIG. 10, similar elements to the configuration described in relation to FIG. 5 will be briefly mentioned and a detailed description thereabout will be omitted.

In relation to FIG. 10, first to sixth light emission control signals ESf1 to ESf6 are illustrated. The first to sixth light emission control signals ESf1 to ESf6 may be light emission control signals provided to the pixel PXx, when the pixel PXx has different luminances (see FIG. 3).

The first to third light emission control signals ESf1 to ESf3 are a portion of the light emission control signals when the pixel PXx has a luminance within a first luminance section BS1*e*, and the fourth to sixth light emission control signals ESf4 to ESf6 are the other portion of the light emission control signals when the pixel PXx has a luminance within a second luminance section BS2*e*. The first luminance section BS2*e* may have a higher luminance than the first luminance section BS1*e*.

In the first luminance section BS1*e*, front points FOL1*e* of off levels of the first to third light emission control signals ESf1 to ESf3 may be adjusted similarly (e.g. substantially identically) to those of the first to third light emission control signals ESa1 to ESa3 (see FIG. 5) as described in relation to FIG. 5. Accordingly, an interval Tx between a data input period td and a first on-period of a light emission control signal after the frame start is fixed.

In the second luminance section BS2*e*, rear points BOL2*e* of off levels of the fourth to sixth light emission control signals ESf4 to ESf6 may be adjusted to be fixed similarly (e.g. substantially identically) to those of the fourth to sixth light emission control signals ESe4 to ESe6 (see FIG. 8) as described in relation to FIG. 8 so as to have a prescribed off duty ratio at which the afterimage phenomenon in which a vestige of a previous image remains may be improved.

According embodiments of the inventive concept, in a first luminance section that is a low luminance section, a front point of an off level of a light emission control signal is controlled to improve a first frame response level, and in a second luminance section that is a high luminance section, a rear point of the off level of the light emission control signal is controlled to improve an afterimage phenomenon in which a vestige of a previous image remains, even when the image is changed to another image.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display device comprising:

a display panel comprising a pixel, wherein the display panel is configured to display an image; and a light emitting control unit configured to output a light emission control signal configured to control a light emitting timing of the pixel in a frame period, wherein the pixel has a first luminance in a first luminance section, and has a second luminance in a second luminance section that is different from the first luminance section, wherein a first time interval between a rising edge of the light emission control signal and a rising edge of a vertical synchronization signal representing a start of the frame period is adjusted in the first luminance section, wherein a second time interval between a falling edge of the light emission control signal and the rising edge of the vertical synchronization signal is adjusted in the second luminance section, and wherein, in the first luminance section, an off duty ratio of the light emission control signal increases as the first luminance becomes lower.

2. The display device of claim 1, wherein a third time interval between the falling edge of the light emission control signal and the rising edge of the vertical synchronization signal is fixed in the first luminance section, and wherein a fourth time interval between the rising edge of the light emission control signal and the rising edge of the vertical synchronization signal is fixed in the second luminance section.

3. The display device of claim 1, wherein the first luminance in the first luminance section is lower than the second luminance in the second luminance section.

4. The display device of claim 3, wherein the pixel further has a third luminance in a third luminance section that is higher than the second luminance in the second luminance section, and wherein, in the third luminance section, a time interval between the rising edge of the light emission control signal and the rising edge of the vertical synchronization signal, and a time interval between the falling edge of the light emission control signal and the rising edge of the vertical synchronization signal, are fixed.

5. The display device of claim 4, wherein, in the third luminance section, an off duty ratio of the light emission control signal is 10% or higher.

6. The display device of claim 1, wherein, in the second luminance section, an off duty ratio of the light emission control signal increases as the second luminance becomes lower.

7. The display device of claim 1, wherein, in the second luminance section, an off duty ratio of the light emission control signal increases as the second luminance becomes higher.

8. The display device of claim 1, wherein, in the first luminance section, a third time interval between the falling edge of the light emission control signal and the rising edge of the vertical synchronization signal is adjusted, and as the first luminance in the first luminance section becomes lower, the third time interval decreases.

9. The display device of claim 1, wherein the pixel further has a third luminance section that is an intermediate luminance section between the first luminance section and the second luminance section, and wherein, in the third luminance section, a time interval between the rising edge of the light emission control signal and the rising edge of the vertical synchronization signal, and a time interval between the falling edge of the light emission control signal and the rising edge of the vertical synchronization signal, are all adjusted.

10. A display device comprising:

a display panel comprising a pixel and configured to display an image; and a light emission control unit configured to output a light emission control signal comprising an on level for driving the pixel to emit light and an off level for causing the pixel to not emit light, wherein the pixel has a first luminance in a first luminance section, and has a second luminance in a second luminance section that is a higher luminance than the first luminance in the first luminance section, wherein a front point of the off level of the light emission control signal is adjusted in the first luminance section, wherein a rear point of the off level of the light emission control signal is adjusted in the second luminance section, and wherein, in the first luminance section, an off duty ratio of the light emission control signal increases as the first luminance becomes lower.

11. The display device of claim 10, wherein the rear point of the off level of the light emission control signal in the first luminance section, and the front point of the off level of the light emission control signal in the second luminance section, are fixed.

12. The display device of claim 10, wherein, in the second luminance section, as the second luminance becomes lower, an off duty ratio of the light emission control signal increases.

13. The display device of claim 10, wherein, in the second luminance section, as the second luminance becomes higher, an off duty ratio of the light emission control signal increases.

14. The display device of claim 10, wherein, in the first luminance section, the rear point of the off level of the light emission control signal is adjusted.

15. A driving method of a display device comprising:

providing a scan signal to a scan line electrically connected to a pixel comprising a pixel circuit and a light emitting element;

delivering, to the pixel circuit, a data signal received from a data line according to a level of the scan signal;

adjusting a duty ratio of a light emission control signal to adjust luminance; and applying, to the pixel circuit, the light emission control signal to control timing when a driving current flows to the light emitting element, wherein, in the adjusting of the duty ratio to adjust the luminance in a first luminance section, a front point of an off level of the light emission control signal is adjusted, wherein, in the adjusting of the duty ratio to adjust the luminance in a second luminance section having a higher luminance than the luminance in the first luminance section, a rear point of the off level of the light emission control signal is adjusted, and wherein, in the first luminance section, an off duty ratio of the light emission control signal increases as the luminance becomes lower.

16. The driving method of claim 15, wherein, in the adjusting of the duty ratio, in the first luminance section, a time interval between a rising edge of the light emission control signal and a rising edge of a vertical synchronization signal that represents a start of a frame period is adjusted, and a time interval between a falling edge of the light emission control signal and the rising edge of the vertical synchronization signal is fixed, and wherein, in the second luminance section, a time interval between the rising edge of the light emission control signal and the rising edge of the vertical synchronization signal is fixed, and a time interval between the falling edge of the light emission control signal and the rising edge of the vertical synchronization signal is adjusted.

17. The driving method of claim 15, wherein, in the second luminance section, an off duty ratio of the light emission control signal increases as the luminance becomes lower.

18. The driving method of claim 15, wherein, in the second luminance section, as the luminance becomes higher, an off duty ratio of the light emission control signal increases.

* * * * *